United States Patent [19]

Babler

[11] Patent Number: 4,810,114

[45] Date of Patent: Mar. 7, 1989

[54] PRINT WHEEL WITH SELF-CONTAINED MEANS FOR PRINT WHEEL ALIGNMENT

[75] Inventor: Egon S. Babler, Northbrook, Ill.

[73] Assignee: Xerox Corporation, Stamford, Conn.

[21] Appl. No.: 733,825

[22] Filed: May 14, 1985

Related U.S. Application Data

[63] Continuation of Ser. No. 356,522, Mar. 9, 1982, abandoned, which is a continuation of Ser. No. 141,446, Apr. 18, 1980, abandoned.

[51] Int. Cl.[4] ..... B41J 1/04; B41J 1/30

[52] U.S. Cl. ..... 400/144.2; 400/175

[58] Field of Search ..... 400/144.2, 144.3, 144.4, 400/171, 172, 174, 175, 169; 178/32, 34, 35, 38

[56] References Cited

U.S. PATENT DOCUMENTS

| | | | |
|---|---|---|---|
| 3,384,216 | 5/1968 | Thayer | 400/144.3 |
| 3,677,386 | 7/1972 | Herterich et al. | 400/163.3 X |
| 3,817,367 | 6/1974 | Tramposch et al. | 400/144.2 |
| 3,878,929 | 4/1975 | Orlens et al. | 400/175 |
| 3,921,780 | 11/1975 | Gentzlinger et al. | 400/175 |
| 4,119,384 | 10/1978 | Keiter | 400/144.2 |
| 4,124,312 | 11/1978 | Johnson | 400/320 X |
| 4,198,169 | 4/1980 | Stuiber et al. | 400/144.2 |
| 4,209,262 | 6/1980 | Savage | 400/144.2 |
| 4,239,400 | 12/1980 | Giolitti | 400/144.2 |
| 4,338,034 | 7/1982 | Babler | 400/144.2 |

FOREIGN PATENT DOCUMENTS

| | | | |
|---|---|---|---|
| 2000783 | 7/1971 | Fed. Rep. of Germany | 400/144.2 |
| 2521027 | 12/1975 | Fed. Rep. of Germany | 400/144.2 |
| 6712688 | 3/1969 | Netherlands | 400/144.2 |

OTHER PUBLICATIONS

IBM Technical Disclosure Bulletin, vol. 16, No. 5, Oct. 1973, p. 1515, "Character Wheel for Low-Cost Changeable Font Printer", by Branson et al.

IBM Technical Disclosure Bulletin, vol. 22, No. 1, Jun. 1979, pp. 1-3, "Impact Printer with Cassette Daisy Wheel Type Font", by Roberti et al.

*Primary Examiner*—Charles A. Pearson

*Attorney, Agent, or Firm*—Richard A. Tomlin; Serge Abend

[57] ABSTRACT

A print wheel for serial printing devices of the type wherein print fonts are arranged upon a disc print wheel member. The print wheel has both coarse alignment and fine alignment means formed therein; the coarse alignment means for driving the print wheel, and the fine alignment means for accurately positioning the wheel during hammer impact.

3 Claims, 2 Drawing Sheets

PRINT WHEEL WITH SELF-CONTAINED MEANS FOR PRINT WHEEL ALIGNMENT

This is a continuation of application Ser. No. 356,522 filed Mar. 9, 1982 which is a continuation of Ser. No. 141,446 filed Apr. 18, 1980 both now abandoned.

The invention relates to a print wheel for serial printing devices and particularly to high-speed serial printers having print fonts arranged upon a disc member. The disc member rotates the characters or fonts past an impacting printer hammer. In a high-speed, high-quality printing system, it is necessary to accurately and rapidly position the disc member so that the printed characters will be aligned and spaced correctly. It is also desirable that, when the print font strikes the ink ribbon, paper and platen, the font be stable, that is, not be subject to vibration in a direction perpendicular to the hammer movement. Such movement can cause smudging or blurring of the final printed character. It is also desirable to have a print wheel that will provide the above advantages and yet be usable with an inexpensive stepper motor in a high-speed system.

The invention as claimed is intended to meet those requirements. A disc or print wheel in accordance with the present disclosure has both a coarse alignment means and a fine alignment means formed on or attached directly to the print wheel. The coarse alignment means is used to drive the print wheel as well as provide coarse alignment of the print wheel; and the fine alignment means is used to accurately position and stabilize the print wheel during print hammer impact. Details regarding how the print wheel interacts with the drive means and the fine alignment means are discussed further herein and in U.S. Pat. No. 4,338,034 granted July 6, 1982 to Egon S. Babler and assigned to the same assignee as the instant application, the disclosure of which is incorporated herein by reference.

One way of carrying out the invention is described in detail below with reference to the drawing, which illustrates only one specific embodiment, in which.

Figure 3:
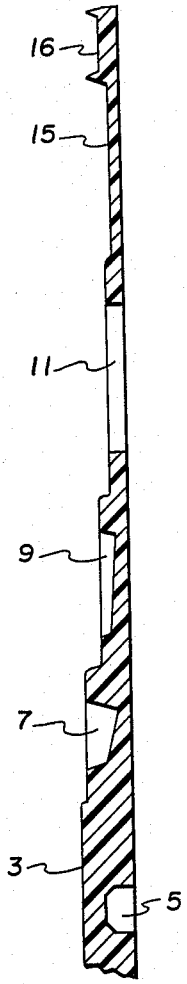

The Figures show a print wheel generally designated as 1, which, in this exemplary embodiment, is molded in one piece of a high-impact compatible material. Hub 3 is formed with a cavity 5 (FIG. 3) in which a steel ball or other suitable member is inserted to act as a pivot around which print wheel 1 is rotated. Extending radially outward from hub 3 is coarse alignment and drive means 7, which, in this exemplary instance, is teeth formed in the body of the print wheel. By way of example, 25 teeth 7 are formed in print wheel 1, which teeth are designed to mate with similar radially extending teeth attached to the drive shaft of a motor. Twenty-five teeth are used conveniently to ease print wheel-to-drive hub engagement also to associate a home position of the print wheel with a particular motor phase, i.e., four phases (100/4=25). A second band of serrations or teeth 9 acts as a fine alignment means. By way of example, 100 teeth 9, equivalent to 100 print positions, are formed, designed to mate with similar radially extending teeth mounted fixed relative to the printer platen, which teeth provide fine alignment of the print wheel 1.

The print wheel 1 can also be provided with one or more holes 11, which can be used for print wheel position sensing means. For example, an LED-photocell arrangement can be used to sense print wheel position by directing light through the holes 11 or by reflecting light off of reflective material (not shown) placed in the holes 11. Holes 11 also decrease print wheel inertia.

Figure 1:
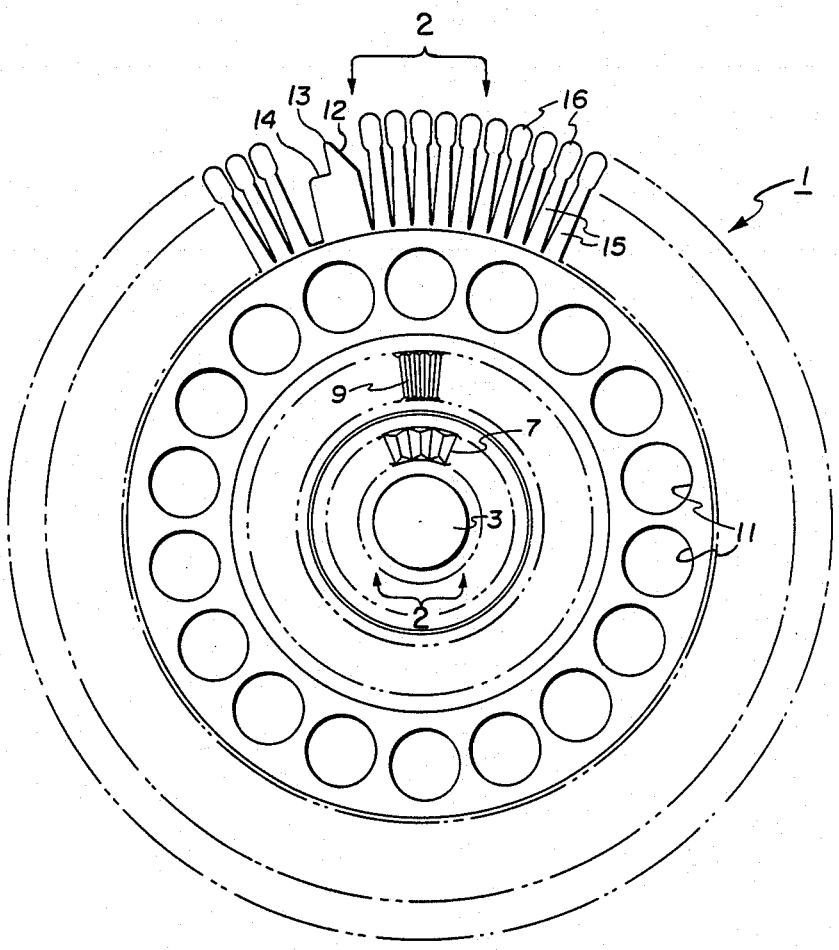
FIG. 1 is a full-face view of a print wheel in accordance with this invention.
Figure 2:
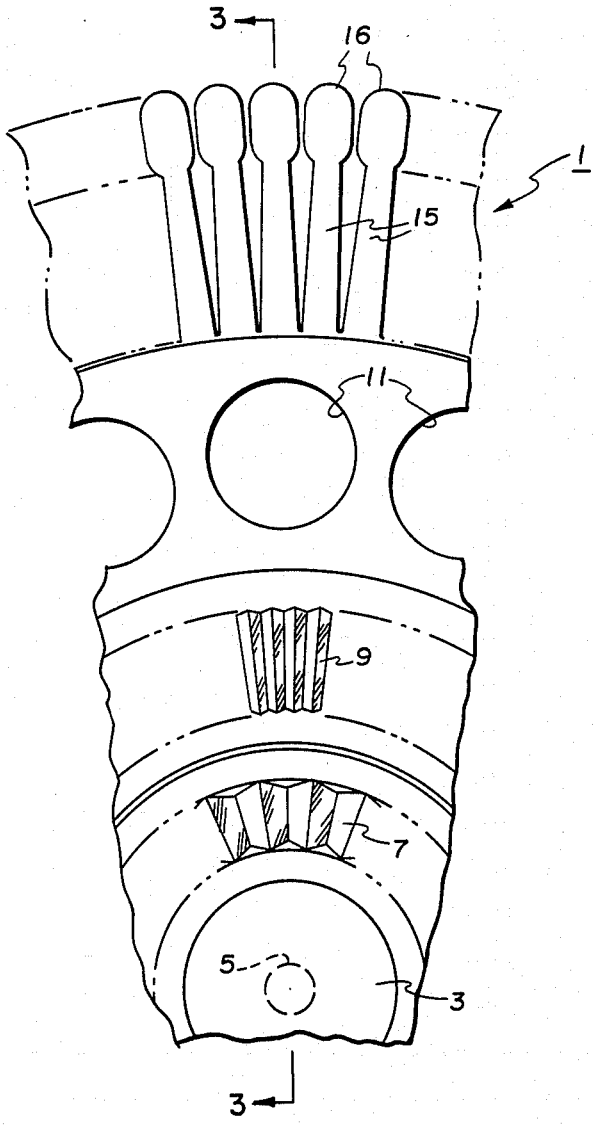
FIGS. 2 and 3 are partial front and partial side-sectional views showing further details.

Next a plurality of spokes or beams 15 extend radially. The print wheel 1 also contains a flag 12 (FIG. 1) extending radially therefrom, which terminates in a pointer 13 and a flat portion 14, which provide a means to align the printed line with the print wheel 1 and allow viewing by the operator of the printed character. The outer end of each spoke 15 is provided with a character slug 16 that has a character (not shown) formed on the printing surface thereof and an impact surface formed on the opposite side of the character slug 16. The printing surface of the character slug 16 faces the platen of the serial impact printer while the impact surface faces and is contacted by the print hammer when the character slug is rotated to a print position.

In operation print wheel 1 is driven to a print position by a drive means connected to coarse alignment means 7. In this exemplary instance, the drive means would be a matching set of 25 teeth for mating with teeth 7 mounted on the drive shaft of a motor. When the print wheel has been coarsely aligned by the drive means at the printing position, the drive means is pulled back out of contact with print wheel 1. The print wheel 1 is moved axially toward the drive motor and platen allowing fine alignment teeth 9 to mate with similar fixed fine alignment teeth, which may be mounted or formed on the drive motor shaft housing or in the cartridge in which the print wheel is mounted. Axial movement of the print wheel into the platen reduces the severe flexing of print wheel fingers required to reach the platen in other systems. The fingers are, therefore, much shorter, which eliminates the radial "ringing" of the fingers when starting and stopping the print wheel. Since the mating fine alignment teeth are fixed, a very accurate fine alignment results. The print wheel 1 is then in position for printing.

The print wheel has no key to engage the print wheel drive motor, the print wheel can accordingly engage the drive motor in any of 25 positions corresponding to the 25 drive teeth. After print wheel insertion, the machine is programmed to rotate the print wheel to the home position as defined by a reflective element or decoding label (not shown) attached to the print wheel. The machine program then keeps track of the print wheel position for subsequent printing.

While the principles of the invention have been made clear in the illustrative embodiments, there will be many modifications in structure, arrangement, proportions, etc., which will occur to those skilled in the art. The appended claims are, therefore, intended to cover and embrace any such modifications within the scope and spirit of the invention.

What is claimed is:

1. A print wheel for a serial printer, said print wheel comprising a disc having a first face and a second face and including:

a central hub a plurality of beams extending radially outwardly from said hub and bearing at their outer ends character slugs having a printing surface formed on said first face, coarse angular alignment means formed on said disc between said hub and said beams, said coarse angular alignment means comprising a first series of teeth arranged in a circular row substantially concentric with said hub, fine angular alignment means formed on said disc between said hub and said beams, said fine angular alignment means comprising a sècond series of teeth more densely packed than said first series of teeth and arranged in a circular row substantially concentric with said hub, and said coarse angular alignment means and said fine angular alignment means are formed on said first face.

2. The print wheel of claim 1 wherein said coarse alignment means is closer to said hub than said fine alignment means.

3. The print wheel of claims 1 or 2 further including means for indicating the position of the print wheel.

* * * * *